US007001570B2

(12) United States Patent
Niimi

(10) Patent No.: US 7,001,570 B2
(45) Date of Patent: Feb. 21, 2006

(54) METAL-MADE SEAMLESS PIPE AND PROCESS FOR PRODUCTION THEREOF

(75) Inventor: Norikazu Niimi, Kasugai (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 10/423,593

(22) Filed: Apr. 25, 2003

(65) Prior Publication Data

US 2003/0202898 A1 Oct. 30, 2003

Related U.S. Application Data

(62) Division of application No. 09/957,261, filed on Sep. 20, 2001, now Pat. No. 6,596,100.

(30) Foreign Application Priority Data

Oct. 3, 2000 (JP) ..... PCT/JP00/06876
Jul. 18, 2001 (JP) ..... 2001-217592

(51) Int. Cl.
*B22F 3/20* (2006.01)

(52) U.S. Cl. ..... 419/41; 419/36

(58) Field of Classification Search ..... 419/41, 419/19, 36

See application file for complete search history.

(56) References Cited

U.S. PATENT DOCUMENTS 3,626,744 A 12/1971 Sorgenfrei
3,899,325 A * 8/1975 Harrison ..... 419/6
4,254,300 A 3/1981 Thompson-Russell
4,913,737 A * 4/1990 Nakamura et al. ..... 408/204
5,284,614 A * 2/1994 Chen et al. ..... 419/20
5,854,966 A * 12/1998 Kampe et al. ..... 419/67
5,910,007 A 6/1999 Shimodaira et al.
6,207,101 B1 * 3/2001 Beall et al. ..... 264/630
6,387,196 B1 * 5/2002 Yamaguchi et al. ..... 148/669
6,540,130 B1 * 4/2003 Rodhammer ..... 228/265
6,551,371 B1 * 4/2003 Furuta et al. ..... 75/235
6,582,651 B1 * 6/2003 Cochran et al. ..... 419/5
6,596,100 B1 * 7/2003 Niimi ..... 148/421

FOREIGN PATENT DOCUMENTS

EP 0 982 278 A1 3/2000
JP 04-33232 A 2/1992

OTHER PUBLICATIONS

European Patent Office, Patent Abstracts of Japan, Publication No. 57161003, Apr. 10, 1982, filing date Mar. 28, 1981, Tadashi, "Manufacture of Porous Seamless Pipe."

* cited by examiner

*Primary Examiner*—Daniel Jenkins
(74) *Attorney, Agent, or Firm*—Burr & Brown

(57) ABSTRACT

A metal-made seamless pipe is provided, containing at least one metal selected from the group consisting of metals each having a melting point of 1,600° C. or more, and has a porosity of 0.3 to 25%. The porosity is defined as a ratio of the open pores present at the outer surface of the pipe to the total surface area of the outer surface of the pipe. The open pores do not include through-pores perforating to the inner surface of the pipe. A process for producing such a metal-made seamless pipe is also provided. The metal-made seamless pipe is low in processability but can be produced having a small thickness and a small inner diameter, having superior mechanical strength and gastightness, and can be suitably used as a sealing member of a translucent vessel of a high-pressure discharge lamp.

6 Claims, 3 Drawing Sheets

METAL-MADE SEAMLESS PIPE AND PROCESS FOR PRODUCTION THEREOF

CROSS REFERENCE TO RELATED APPLICATION

This application is a division of U.S. application Ser. No. 09/957,261, filed Sep. 20, 2001 now U.S. Pat. No. 6,596, 100, the entirety of which is incorporated herein by reference.

BACKGROUND OF THE INVENTION AND RELATED ART STATEMENT

The present invention relates to a metal-made seamless pipe and a process for producing such a pipe. More particularly, the present invention relates to a metal-made seamless pipe which is low in processability but can be produced having a small thickness and a small inner diameter, having superior mechanical strength and gastightness, and which can be suitably used, as a sealing member of a translucent vessel (e.g. a ceramic-made translucent vessel) of, for example, a high-pressure discharge lamp (e.g. a metal halide lamp). The present invention also relates to a process for producing such a metal-made seamless pipe.

As shown in FIG. 5, a translucent ceramic pipe 20 (a translucent pipe) is used as a translucent vessel of a high-pressure discharge lamp 10 (e.g. a metal halide lamp), because the translucent vessel contains a light emitting material (e.g. dysprosium iodide) of high corrosivity and accordingly requires corrosion resistance.

In order to seal the translucent ceramic pipe 20 (a translucent pipe) used as a translucent vessel, a metal-made pipe 30 (e.g. a Mo pipe) was proposed as a sealing member (European Patent Publication EP 0982278A1).

The metal (e.g. Mo or W) used in such a metal-made pipe, however, is generally low in processability and there has been a limit in producing the pipe in a small thickness and a small inner diameter.

Since the metal is low in processability and its cutting is difficult, production of a metal-made pipe therefrom has ordinarily been conducted by sintering a metal ingot and subjecting the sintered metal ingot to rolling, drawing or the like to obtain a pipe-shaped material. In such a production process, it has been extremely difficult to obtain a metal-made pipe of small thickness and small diameter.

In view of the above-mentioned problems, the object of the present invention is to provide a metal-made seamless pipe which is low in processability but can be produced having a small thickness and a small inner diameter, having superior mechanical strength and gastightness, and which can be suitably used as a sealing member of a translucent vessel (e.g. a ceramic-made translucent vessel) of, for example, a high-pressure discharge lamp (e.g. a metal halide lamp), and a process for producing such a metal-made seamless pipe.

SUMMARY OF THE INVENTION

In order to achieve the above objects, the present invention provides a metal-made seamless pipe and a process for production thereof, both shown below.

A metal-made seamless pipe is provided containing, as a main component, at least one kind of metal selected from the group consisting of metals each having a melting point of 1,600° C. or more. The pipe has a porosity of 0.3 to 25%, when the porosity is defined as a ratio of the open pores present at the outer surface of the pipe to the total surface area (100%) of the outer surface of the pipe without through-pores perforating in the thickness direction of the pipe.

According to another embodiment of the present invention, the metals each having a melting point of 1,600° C. or more are preferably Mo, W, Re, Ti, Hf and Zr.

According to another embodiment of the metal-made seamless pipe of the present invention, the melting point of each metal is 2,600° C. or more. The metals each having a melting point of 2,600° C. or more are preferably Mo, W and Re.

Preferably, the metal-made seamless pipe of the present invention has an inner diameter of 0.4 to 3.0 mm and a thickness of 0.05 to 1.0 mm.

According to another embodiment of the present invention, the metal-made seamless pipe further contains, in addition to the metal, at least one kind of oxide selected from the group consisting of $Al_2O_3$, $Y_2O_3$, $Dy_2O_3$, $Gd_2O_3$, $Ho_2O_3$ and $Tm_2O_3$, in an amount of 0.02 to 5% by volume relative to 100% of the total of the metal and the oxide.

The present invention also provides a process for producing a metal-made seamless pipe, comprising the steps of preparing a mixture containing (1) 80 to 98% by weight of a powder of at least one kind of metal selected from the group consisting of metals each having a melting point of 1,600° C. or more and (2) a binder in a solvent, and kneading the mixture for 0 to 3 hours to form a kneaded material. Then, the kneaded material is extruded to form a pipe-shaped material. The pipe-shaped material is dried at a temperature in a range of −5 to 25° C. for 10 hours (shortest) to 48 hours (longest) from the completion of the extrusion, and thereafter dried at a temperature in a range of 30 to 120° C. for 0.5 to 8 hours. The dried material is then fired at a lower temperature selected from a temperature between 1,000 to 2,100° C. and a temperature lower by 300° C. than the melting point of the metal.

According to the above process for producing a metal-made seamless pipe of the present invention, the metals each having a melting point of 1,600° C. or more are preferably Mo, W, Re, Ti, Hf and Zr.

According to another embodiment of the present invention, the melting point of each metal is 2,600° C. or more. Preferably, the metals each having a melting point of 2,600° C. or more are Mo, W and Re.

According to the present invention, the metal-made seamless pipe obtained after firing of the dried pipe-shaped material at a lower one of a temperature selected from a temperature between 1,000 to 2,100° C. and a temperature 300° C. lower than the melting point of the metal, has an inner diameter of 0.4 to 3.0 mm and a thickness of 0.05 to 1.0 mm.

According to another embodiment of the present invention, a process for producing a metal-made seamless pipe is provided, wherein the preparation of the mixture further includes the step of adding, in addition to the components used, at least one kind of oxide selected from the group consisting of $Al_2O_3$, $Y_2O_3$, $Dy_2O_3$, $Gd_2O_3$, $Ho_2O_3$ and $Tm_2O_3$, in an amount of 0.02 to 5% by volume relative to 100% of the total of the metal and the oxide.

According to the present invention, the drying of the pipe-shaped material is preferably conducted in an atmosphere containing the vapor of the solvent.

DETAILED DESCRIPTION OF THE INVENTION

Figure 1:
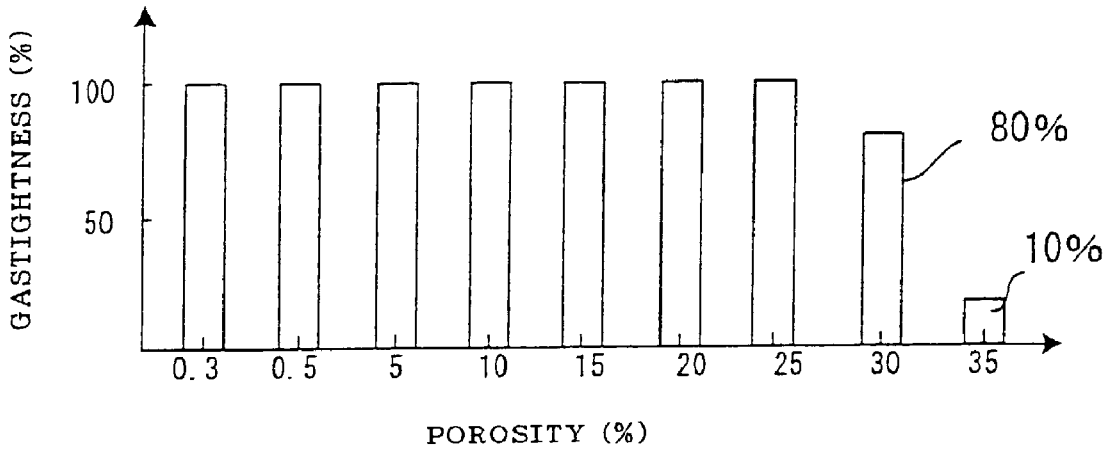
FIG. 1 is a graph showing of the relationship between the porosity and the gastightness of a metal-made seamless pipe according to the present invention.

The preferred embodiments of the metal-made seamless pipe and the process for production thereof, both of the present invention, are specifically described below with reference to the accompanying drawings.

The metal-made seamless pipe of the present invention contains, as a main component, at least one kind of metal selected from the group consisting of metals each having a melting point of 1,600° C. or more, and has a porosity of 0.3 to 25%. The porosity is defined as a ratio of the open pores present at the outer surface of the pipe to the total surface area (100%) of the outer surface of the pipe, without through-pores perforating in the thickness direction of the pipe.

The metal-made seamless pipe of the present invention has higher resistance to leakage and breaking than pipes having seams, because it has no seam. When a metal-made pipe having a seam is used as a sealing member for a translucent vessel of high-pressure discharge lamp (e.g. metal halide lamp), leakage (breakage) tends to occur therefrom because the pressure inside the translucent vessel becomes several atm. during the operation of the tube, resulting in lower reliability than in the case of a seamless pipe.

As to the kind of the metal having a melting point of 1,600° C. or more used in the present invention, there is no particular restriction. Preferable examples of the metal include at least one kind of metal selected from Mo (melting point: 2,623° C.), W (melting point: 3,422° C.), Re (melting point: 3,186° C.), Ti (melting point: 1,668° C.), Hf (melting point: 2,233° C.) and Zr (melting point: 1,855° C.), all having corrosion resistance to the substance sealed into the translucent vessel.

Incidentally, Mo and W have a body-centered cubic crystal structure, have a high melting point as mentioned above, and have a very high Vickers hardness of 200 to 450. Re, Ti, Hf and Zr have a close-packed cubic crystal structure, have a high melting point, and are low in crystal slip. Therefore, these metals are very low in processability.

In the present invention, the phrase "open pores other than through-pores" refers to pipe-surface pores not perforating (not causing leakage) in the thickness direction of pipe. Such open pores can be confirmed by conducting a He leakage test and making an image analysis for the outer surface porosity.

As shown in Table 1, when the porosity of the metal-made seamless pipe exceeds 25%, its gastightness is low.

Herein, the "gastightness" is measured by fitting a metal-made pipe of 1 mm in outer diameter, 0.7 mm in inner diameter (therefore, 0.3 mm in thickness) and 100 mm in length to a He detector. When the pipe sample number is 10 and all the samples are gastight, the gastightness of the pipe is taken as 100%. The term "gastight" refers to the results of the He leakage test, when the leakage rate is 1.0×10−10 atm.cc/sec or less.

The lower limit of the outer surface porosity is determined by the wettability toward other substances, particularly, cement, ceramic, glass or the like. A lower limit smaller than 0.3% is not preferred, as is clear from the results of the following peeling test.

Peeling Test

Figure 2:
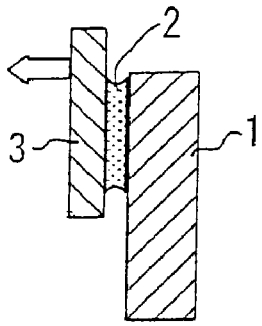
FIG. 2 is a sectional view schematically showing a peeling test, which comprises peeling a thin W plate attached to an alumina plate via an $Al_2O3$—$Y_2O_3$—$Dy_2O_3$—$La_2O_3$ type ceramic composition, from the alumina plate at a given force.

As shown in FIG. 2, a thin W plate 3 was attached to an alumina plate 1 via an $Al_2O_3$—$Y_2O_3$—$Dy_2O_3$—$La_2O_3$ type ceramic composition; the thin W plate 3 was peeled from the alumina plate 1; and the sites of breakage and the evaluations are shown in Table 1.

TABLE 1

| | | Site of breakage | Evaluation |
|---|---|---|---|
| Porosity of thin W plate (%) | 0.1 | Thin W plate surface<br>No breakage of ceramic | X |
| | 0.2 | Thin W plate surface<br>No breakage of ceramic | X |
| | 0.3–0.5 | Thin W plate surface<br>Ceramic on W plate: small | Δ |
| | 1.0 | Ceramic on W plate:<br>Small to medium | Δ - ○ |
| | 3.0 | Ceramic on W plate: medium | ○ |
| | 5.0 | Ceramic on W plate: large | ○ |

As is clear from Table 1, the presence of the ceramic on the thin W plate (the remaining of ceramic composition on the surface side of the thin W plate contacting with the ceramic composition when the thin W plate was peeled) indicates a high wettability, i.e. high adhesivity between the thin W plate and ceramic composition. Therefore, a large amount of ceramic on the thin W plate was rated as ○. No ceramic on the thin W plate was rated as X, and the intermediate between them was rated as Δ. It is appreciated from Table 1 that a porosity of less than 0.3% gives low adhesivity.

When a metal of relatively low melting point is used, sintering takes place early and proceeds before the binder gas is released; pores are generated inside in a large amount and easily become through-pores. As a result, the gastightness tends to be low before a porosity of 25% (the upper limit of specified range) is reached.

Figure 3:
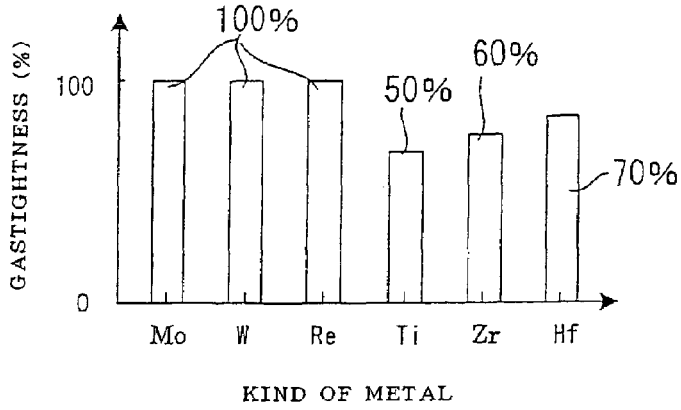
FIG. 3 is a graph showing the gastightnesses when Mo, W, Re, Ti, Hf and Zr were used and their porosities were all fixed at 5%.

The gastightnesses when Mo, W, Re, Ti, Hf and Zr are used are compared by fixing the porosity at 5% for all cases. As shown in FIG. 3, the preferred metals are metals having a melting point of 2,600° C. or more, i.e. Mo (melting point=2,623° C.), W (melting point=3,422° C.) and Re (melting point=3,186° C.).

Figure 4:
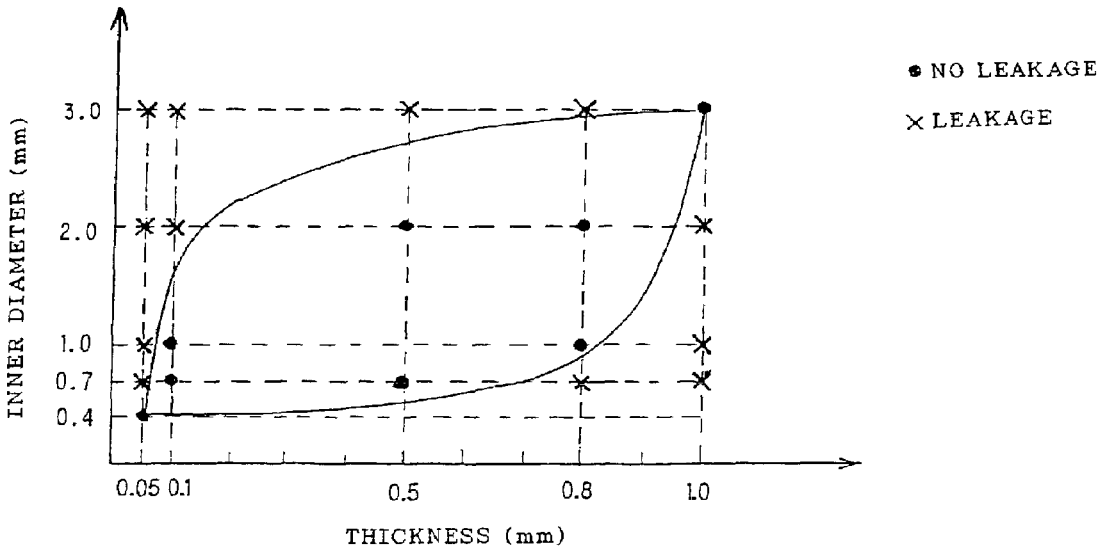
FIG. 4 is a graph showing of the relationship between the thickness, the inner diameter and the gastightness of a metal-made seamless pipe according to the present invention.
Figure 5:
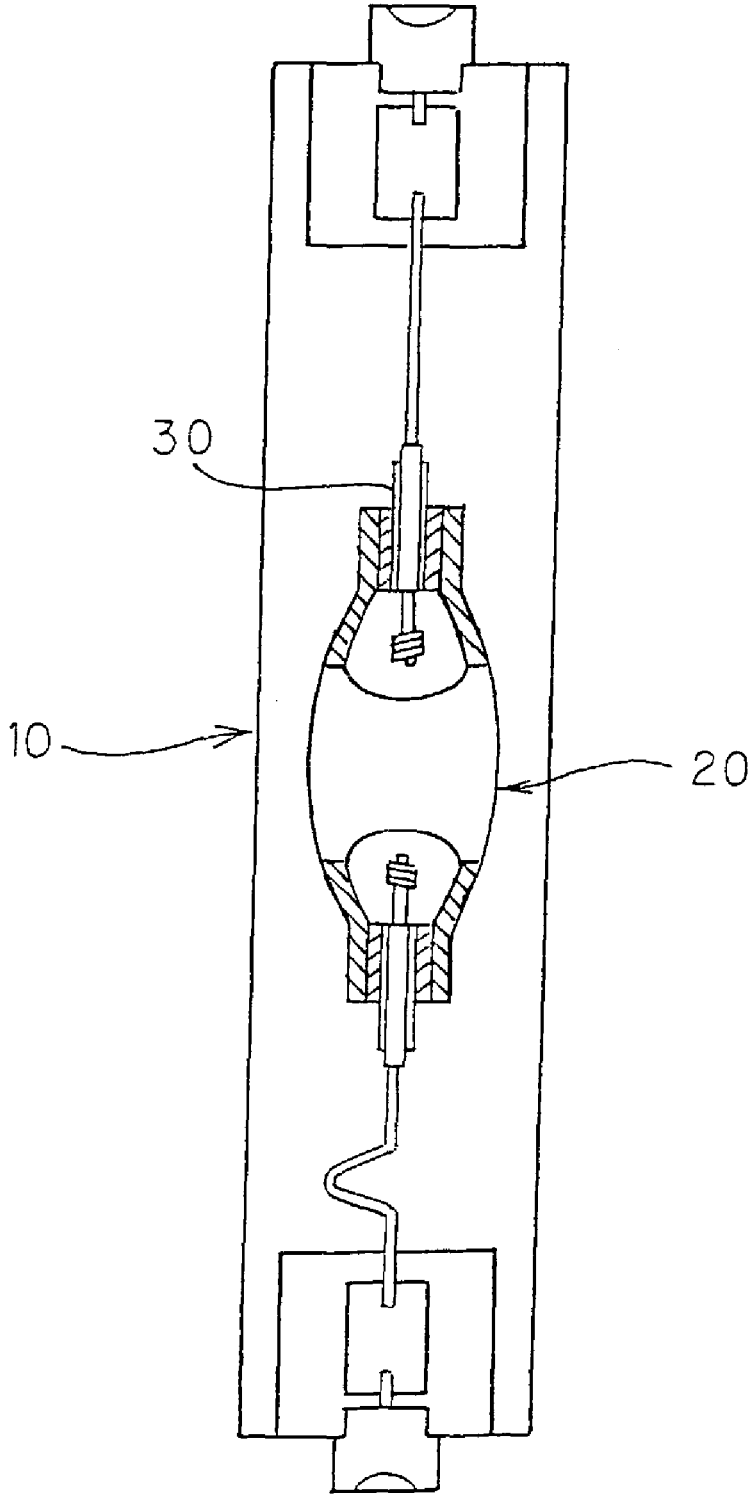
FIG. 5 is a sectional view schematically showing a metal-made seamless pipe used as a sealing member for the ceramic-made translucent vessel of a high-pressure discharge lamp (e.g. a metal halide lamp).

The metal-made seamless pipe of the present invention preferably has an inner diameter of 0.4 to 3.0 mm and a thickness of 0.05 to 1.0 mm. As shown in FIG. 4, no leakage occurs (therefore, superior gastightness is obtained) in a certain region where the inner diameter and the thickness are in the above ranges.

For example, when the inner diameter is 3 mm and the thickness is 0.05 mm, the inner diameter is too large and no sufficient increase in density takes place during molding. Thus, leakage occurs when the thickness is as small as 0.05 mm.

When the inner diameter is 0.4 mm and the thickness is 1.0 mm, however, the thickness is too large and non-uniform drying occurs after molding. As a result, drying cracks (microcracks) appear and leakage is incurred.

Preferably, the metal-made seamless pipe of the present invention further contains, in addition to the metal, at least one kind of oxide selected from the group consisting of $Al_2O_3$, $Y_2O_3$, $Dy_2O_3$, $Gd_2O_3$, $Ho_2O_3$ and $Tm_2O_3$, in an amount of 0.02 to 5% by volume, preferably 0.05 to 2% by volume relative to 100% of the total of the metal and the oxide, to improve strength. When the amount of the oxide is less than 0.02% by volume, the strength improvement effect is low. When the amount of the oxide is more than 5% by volume, adverse effects, such as reduction in gastightness, brittleness and the like, may appear. Of the above oxides, $Al_2O_3$ is preferred for corrosion resistance.

The process for producing a metal-made seamless pipe according to the present invention comprises preparing a mixture containing (1) 80 to 98% by weight of a powder of at least one kind of metal selected from the group consisting of metals each having a melting point of 1,600° C. or more and (2) a binder in a solvent; kneading the mixture for 0 to 3 hours, preferably 1 to 2 hours, and then extruding the kneaded material to form a pipe-shaped material. The pipe-shaped material is dried at a temperature in a range of −5 to 25° C. (preferably −2 to 15° C.) for 10 hours (shortest) to 48 hours (preferably 24 hours) (longest) from the completion of the extrusion and thereafter at 30 to 120° C., preferably 80 to 100° C. for 0 to 8 hours, preferably 0.5 to 4 hours. The dried material is then fired at a lower one of a temperature selected from a temperature between 1,000 to 2,100° C. and a temperature 300° C. lower than the melting point of the metal.

Thus, in the present process for producing a metal-made seamless pipe, mild drying is conducted for a given length of time from the completion of the extrusion. This mild drying is necessary to remove the extrusion strain, etc. remaining right after the extrusion (i.e., at the start of drying). In drying of a pipe-shaped material in particular, the drying speed is inevitably higher than that of a solid (non-hollow) material. Therefore, its drying right after extrusion needs to be mild. Residual extrusion stress becomes a main cause for firing deformation, etc.

As to the preparation of the mixture, there is no particular restriction. In this step, when the content of the metal powder is less than 80% by weight, drying cracks may appear; when the content of the metal powder is more than 98% by weight, the dispersion of the metal particles may be insufficient.

There is no particular restriction, either, as to the method of kneading and extrusion in the extrusion step.

There is no particular restriction, either, as to the method of drying.

The firing in the firing step is conducted in a non-oxidizing atmosphere or in vacuum. In the firing step, when the firing temperature is less than a lower one of a temperature selected from 1,000° C. and a temperature 300° C. lower than the melting point of the metal, insufficient sintering may take place; when the firing temperature is higher than a lower one of a temperature selected from 2,100° C. and a temperature 300° C. lower than the melting point of the metal, firing deformation may take place depending upon the kind of the metal used.

By employing such a production process, it is possible to easily obtain a thin, small-diameter seamless pipe which has been difficult to obtain with conventional processes. Therefore, productivity improvement and consequently, cost reduction, can be achieved.

The drying of the pipe-shaped material is preferably conducted in an atmosphere containing the vapor of the solvent used in the mixture. By employing such a production process, mild drying becomes possible and the extrusion strain can be reduced.

The present invention is specifically described below by way of Example. However, the present invention is in no way restricted by this Example.

EXAMPLE

To 1,000 g of a powder of W (melting point=3,422° C. were added 12 g of ethyl cellulose (a binder), 30 g of butylcarbitol acetate (a solvent) and 10 g of additives including $Al_2O_3$. The mixture was passed through a tri-roll mill ten times.

The mixture was molded by an extruder. The extrudate was dried in the air at 80° C. for 2 hours.

The dried material was fired in hydrogen at 1,900° C. for 3 hours. To remove the binder while preventing the oxidation of Mo, moistening was made to obtain a dew point of 0° C.

By the above treatment, a Mo pipe was produced having a porosity of 8% and a leakage rate of 1.0×10−10 atm. cc/sec or less in the He leakage test.

As described above, the present invention can provide a metal-made seamless pipe which is low in processability but can be produced having a small thickness and a small inner diameter, having superior mechanical strength and gastightness, and which can be suitably used as a sealing member of a translucent vessel (e.g. a ceramic-made translucent vessel) of, for example, a high-pressure discharge lamp (e.g. a metal halide lamp); and a process for producing such a metal-made seamless pipe.

The present metal-made seamless pipe produced from a metal of low processability can also be suitably used as a fine pipe of, for example, heat exchangers used in extreme situations such as space, aviation, military and the like, due to its small thickness, small inner diameter, high heat resistance, high mechanical strength and superior gastightness.

The invention claimed is:

1. A process for producing a metal-made seamless pipe, which comprises:

preparing a mixture containing (1) 80 to 98% by weight of a powder of at least one metal selected from the group consisting of Mo, W, Re, Ti, Hf and Zr, each having a melting point of 1,600° C. or more and (2) a binder in a solvent;

kneading the mixture for up to 3 hours and then extruding the kneaded material to form a pipe-shaped material; and drying the pipe-shaped material at −5 to 25° C. for 10 hours to 48 hours from the completion of the extrusion and thereafter at 30 to 120° C. for 0.5 to 8 hours and then firing the dried material at a lower temperature selected from a temperature between 1,000 to 2,100° C. and a temperature lower by 300° C. than the melting point of the metal.

2. The process for producing a metal-made seamless pipe according to claim 1, wherein said melting point of each said metal is 2,600° C. or more.

3. The process for producing a metal-made seamless pipe according to claim 2, wherein said at least one metal having a melting point of 2,600° C. or more is selected from the group consisting of Mo, W and Re.

4. The process for producing a metal-made seamless pipe according to claim 1, wherein said metal-made seamless pipe has an inner diameter in a range of 0.4 to 3.0 mm and a thickness in a range of 0.05 to 1.0 mm.

5. The process for producing a metal-made seamless pipe according to claim 1, wherein said preparing step further comprises adding at least one oxide selected from the group consisting of $Al_2O_3$, $Y_2O_3$, $Dy_2O_3$, $Gd_2O_3$, $Ho_2O_3$and $Tm_2O_3$ in an amount of 0.02 to 5% by volume relative to 100% of the total of said metal and said oxide.

6. The process for producing a metal-made seamless pipe according to claim 1, wherein said drying step is conducted in an atmosphere containing a vapor of said solvent.

* * * * *